US008401746B2

(12) United States Patent
Kahle

(10) Patent No.: US 8,401,746 B2
(45) Date of Patent: Mar. 19, 2013

(54) EXCAVATOR CONTROL USING RANGING RADIOS

(75) Inventor: Kent Kahle, Dayton, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 560 days.

(21) Appl. No.: 12/641,975

(22) Filed: Dec. 18, 2009

(65) Prior Publication Data

US 2011/0153167 A1 Jun. 23, 2011

(51) Int. Cl.
*G06F 19/00* (2011.01)

(52) U.S. Cl. ..... 701/50; 701/485; 701/492; 342/463; 37/414

(58) Field of Classification Search ..... 701/50, 701/408, 484, 485, 492; 342/450, 463; 37/414–416
See application file for complete search history.

(56) References Cited

U.S. PATENT DOCUMENTS

| | | | | |
|---|---|---|---|---|
| 4,820,041 | A * | 4/1989 | Davidson et al. | 356/3.12 |
| 5,062,264 | A | 11/1991 | Frenette et al. | |
| 5,198,800 | A * | 3/1993 | Tozawa et al. | 340/573.1 |
| 5,461,803 | A | 10/1995 | Rocke | |
| 5,546,093 | A * | 8/1996 | Gudat et al. | 701/25 |
| 5,996,702 | A * | 12/1999 | Hall | 172/4.5 |
| 6,263,595 | B1 * | 7/2001 | Ake | 37/348 |
| 6,447,240 | B1 | 9/2002 | Cain et al. | |
| 6,691,437 | B1 * | 2/2004 | Yost et al. | 37/348 |
| 6,917,846 | B1 * | 7/2005 | Muller | 700/108 |
| 7,205,939 | B2 * | 4/2007 | Zimmerman | 342/464 |
| 7,345,627 | B2 * | 3/2008 | Zimmerman et al. | 342/357.27 |
| 7,382,318 | B2 * | 6/2008 | Zimmerman et al. | 342/464 |
| 7,385,554 | B2 * | 6/2008 | Zimmerman et al. | 342/464 |
| 7,532,160 | B1 * | 5/2009 | Zimmerman et al. | 342/357.27 |
| 7,768,450 | B2 * | 8/2010 | Nichols | 342/464 |
| 7,984,184 | B2 * | 7/2011 | Woon et al. | 709/245 |

(Continued)

FOREIGN PATENT DOCUMENTS

| | | |
|---|---|---|
| CN | 101481918 | 7/2009 |
| CN | 101535573 | 9/2009 |

(Continued)

OTHER PUBLICATIONS

Behzadan et al, Ubiquitous Location Tracking for Context-Specific Information Delivery on Construction Sites, Automation in Construction, vol. 17, Iss. 6, Aug. 2008, pp. 737-748.*

(Continued)

*Primary Examiner* — Russell Frejd
(74) *Attorney, Agent, or Firm* — Dinsmore & Shohl LLP

(57) ABSTRACT

A system for use with an excavator of the type having a chassis, bucket support elements including a boom extending from the chassis and a dipper stick pivotally mounted on the end of the boom, and an excavator bucket pivotally mounted on the end of the dipper stick, determines the position of the excavator bucket during operation of the excavator at a worksite. The system includes a plurality of fixed ranging radios that are positioned at known locations at the worksite. A pair of ranging radios is mounted on the chassis of the excavator. A third ranging radio is mounted on one of the bucket support elements. A measurement circuit is responsive to the pair of ranging radios and to the third ranging radio, and determines the position and orientation of the excavator chassis, the bucket support elements, and the bucket with respect to the plurality of fixed ranging radios.

16 Claims, 5 Drawing Sheets

U.S. PATENT DOCUMENTS

| | | | | |
|---|---|---|---|---|
| 2007/0040744 | A1* | 2/2007 | Zimmerman et al. | 342/464 |
| 2007/0285308 | A1* | 12/2007 | Bauregger et al. | 342/357.02 |
| 2008/0000111 | A1* | 1/2008 | Green | 37/348 |
| 2008/0247758 | A1 | 10/2008 | Nichols | |
| 2009/0115658 | A1* | 5/2009 | Zimmerman et al. | 342/357.12 |
| 2010/0201829 | A1* | 8/2010 | Skoskiewicz et al. | 348/211.2 |
| 2011/0133990 | A1* | 6/2011 | Kahle | 342/463 |

FOREIGN PATENT DOCUMENTS

| | | |
|---|---|---|
| DE | 697 16 672 | 6/1997 |
| DE | 696 36 494 | 8/1997 |
| EP | 0717261 | 6/1996 |
| WO | WO2008/124448 | 10/2008 |

OTHER PUBLICATIONS

Minamoto et al, Tele-Presence Information and Remote-Controlled Task Execution, IEEE/RSJ International Conference on Intelligent Robots and Systems, 1998, pp. 1102-1106.*

German Office Action, dated Mar. 12, 2012, German Appln. No. 10 2010 060 137.3 Trimble Navigation Limited.

Chinese Office Action, dated Feb. 28, 2012, Chinese Appln. No. 201010589179.0 Trimble Navigation Limited.

* cited by examiner

EXCAVATOR CONTROL USING RANGING RADIOS

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Control systems have been developed for monitoring and automatically controlling the operation of various types of construction equipment, such as for example excavators. Such systems of this general type are disclosed in U.S. Pat. No. 5,461,803, issued Oct. 31, 1995, to Rocke; U.S. Pat. No. 5,062,264, issued Nov. 5, 1991, to Frenette et al; and U.S. Pat. No. 6,447,240, issued Sep. 10, 2002, to Cain et al. In each of these patents, a positioning and control system is disclosed that includes an arrangement for measuring the relative positions of various machine elements.

While it is desirable to be able to determine the relative positions of machine components, it is also useful to be able to monitor the position of a machine at a construction worksite. Global positioning systems, laser systems, and ranging radio systems have been developed and combined to accomplish this goal. One such system is shown in U.S. Pub. No. US 2008/0247758, to Nichols, published Oct. 9, 2008. The Nichols published application discloses various combinations of GPS, laser, and ranging radio receivers that are carried on a mobile user unit.

Ranging radios offer an excellent alternative to GPS receivers for positioning applications where GPS reception is not available or use of GPS receivers is not desired. For example, GPS receivers require line of sight access to multiple satellites in order to function properly. This may not be possible in some operational settings, such as when work is being performed indoors, underground, or in cluttered environments. For example, when an excavator is operated in a strip mine, it may work adjacent a mine wall that effectively blocks out some or all of the satellite transmissions that are needed for proper GPS function. As another example, an excavator may be operated in mountainous or heavily forested areas, and GPS operation may be impractical.

Ranging radios, operating at ultra wideband (UWB) frequencies, provide very accurate measurement of distances between radios using time of flight analysis. To perform a range measurement, an originating ranging radio transmits a packet consisting of a synchronization preamble and a header. The header contains the range command with the address of the destination radio which is requested to respond to the packet. The originating radio resets its main counter at the time of this transmission, establishing a local time-zero reference. When the destination ranging radio receives the range request addressed to it, it records the time of receipt, and replies with its own packet, including the time of receipt and the time of the responding transmission in the header. The originating radio receives the ranging packet back from the destination radio, records its time of receipt and latches its main counter. The range value is then calculated and recorded, utilizing the time information to compensate for the differences in the timing clocks at the two radios.

It is desirable to provide an improved system using ranging radios in which the positions of the operating elements of an excavator or other machine can be determined and controlled.

SUMMARY OF THE INVENTION

A system for use with an excavator of the type having a chassis, bucket support elements including a boom extending from the chassis and a dipper stick pivotally mounted on the end of the boom, and an excavator bucket, pivotally mounted on the end of the dipper stick, determines the position of the excavator bucket during operation of the excavator at a worksite. The system includes a plurality of fixed ranging radios positioned at known locations at the worksite, a pair of ranging radios mounted on the chassis of the excavator, a third ranging radio mounted on one of the bucket support elements, and a measurement circuit. The measurement circuit is responsive to the pair of ranging radios and to the third ranging radio, and determines the position and orientation of the excavator chassis and the bucket support elements with respect to the plurality of fixed ranging radios.

The third ranging radio may be mounted on the boom of the excavator. Alternatively, the third ranging radio may be mounted on the dipper stick of the excavator. The system may further include an angle sensor that provides an output indicating the angular orientation between the boom and the dipper stick. The system may further comprise an angle sensor providing an output indicating the angular orientation between the dipper stick and the bucket. The measurement circuit is responsive to the angle sensor outputs. A display is positioned on the excavator to indicate the position and orientation of the excavator chassis and the bucket support elements to the operator. The display also indicates the position and orientation of the bucket with respect to the plurality of fixed ranging radios. The system may further include a control that controls the movement of the bucket to desired positions. If desired, the system may further include an inclinometer providing an output indicating the inclination of the dipper stick, with the measurement circuit being responsive to the inclinometer.

A bucket sensing system for use with an excavating machine of the type having a chassis, a boom pivotally secured to the chassis at a first pivot joint, a dipper stick pivotally secured to the boom at a second pivot joint, and a bucket pivotally secured to the dipper stick at a third pivot joint, may include a plurality of fixed ranging radios positioned at known locations at a worksite, and a pair of ranging radios mounted on the chassis of the excavating machine. The system further includes a third ranging radio, mounted on the dipper stick adjacent the second pivot joint and providing an indication of the relative location of the third ranging radio with respect to the plurality of fixed ranging radios, an angle sensor for sensing the angle between the boom and the dipper stick, and a position determining circuit, responsive to the angle sensor, to the pair of ranging radios, and to the third ranging radio, for determining the position of the third pivot joint based on the outputs of the angle sensor and the ranging radios. The sensing system may further include an angle sensor for sensing the angle between the dipper stick and the bucket. The position determining circuit may determine the position of the bucket teeth based on the outputs of the angle sensors and the ranging radios. The system may further comprise a display on the excavating machine for displaying to the machine operator the position of the bucket.

A bucket sensing system for use with an excavating machine of the type having a chassis, a boom pivotally secured to the chassis at a first pivot joint, a dipper stick pivotally secured to the boom at a second pivot joint, and a bucket pivotally secured to the dipper stick at a third pivot joint, may include a plurality of fixed ranging radios positioned at known locations at a worksite, and a pair of ranging radios mounted on the chassis of the excavating machine. The system further includes a third ranging radio, mounted on the boom adjacent the second pivot joint and providing an indication of the relative location of the third ranging radio with respect to the plurality of fixed ranging radios, an angle sensor for sensing the angle between the boom and the dipper stick, and a position determining circuit, responsive to the angle sensor, to the pair of ranging radios, and to the third ranging radio, for determining the position of the third pivot joint based on the outputs of the angle sensor and the ranging radios. The sensing system may further include an angle sensor for sensing the angle between the dipper stick and the bucket. The position determining circuit may determine the position of the bucket teeth based on the outputs of the angle sensors and the ranging radios. The system may further comprise a display on the excavating machine for displaying to the machine operator the position of the bucket.

DETAILED DESCRIPTION OF THE PREFERRED EMBODIMENT

Figure 1:
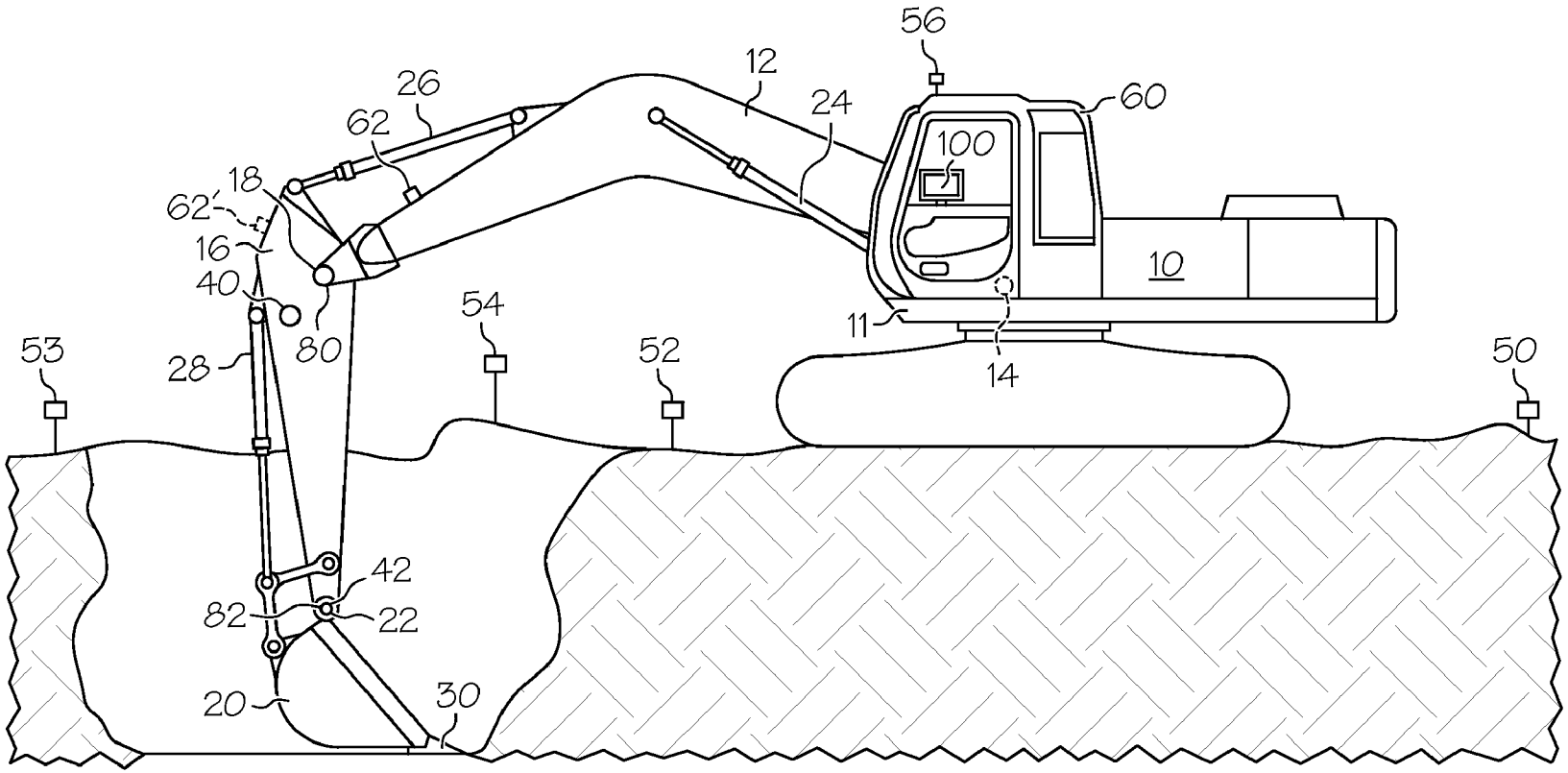
FIG. 1 is a side diagrammatic view of an embodiment of the bucket sensing system.
Figure 2:
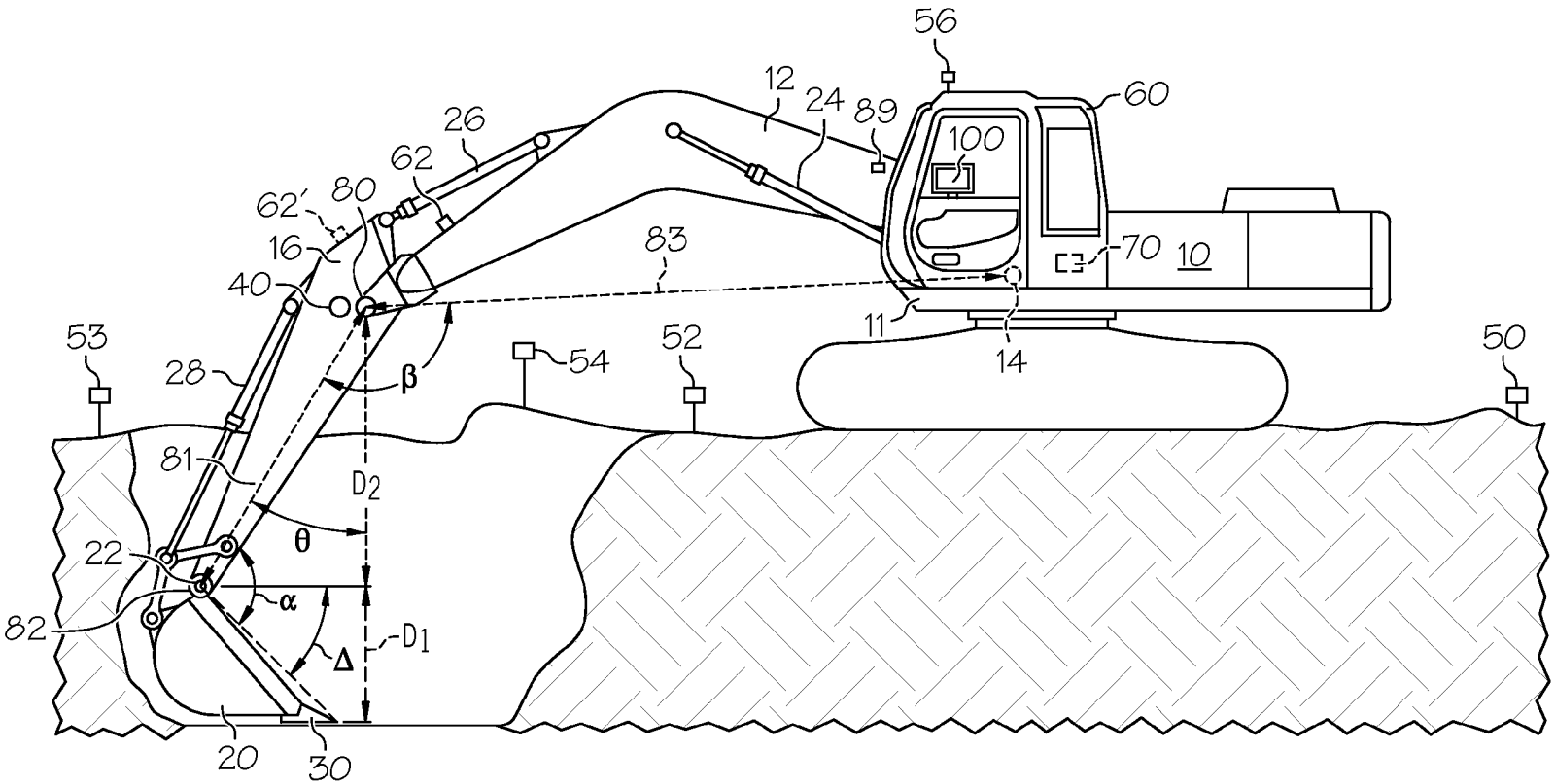
FIG. 2 is a side diagrammatic view of the embodiment of the bucket sensing system of FIG. 1, but with the excavator boom, dipper stick and bucket moved to different positions.
Figure 3:
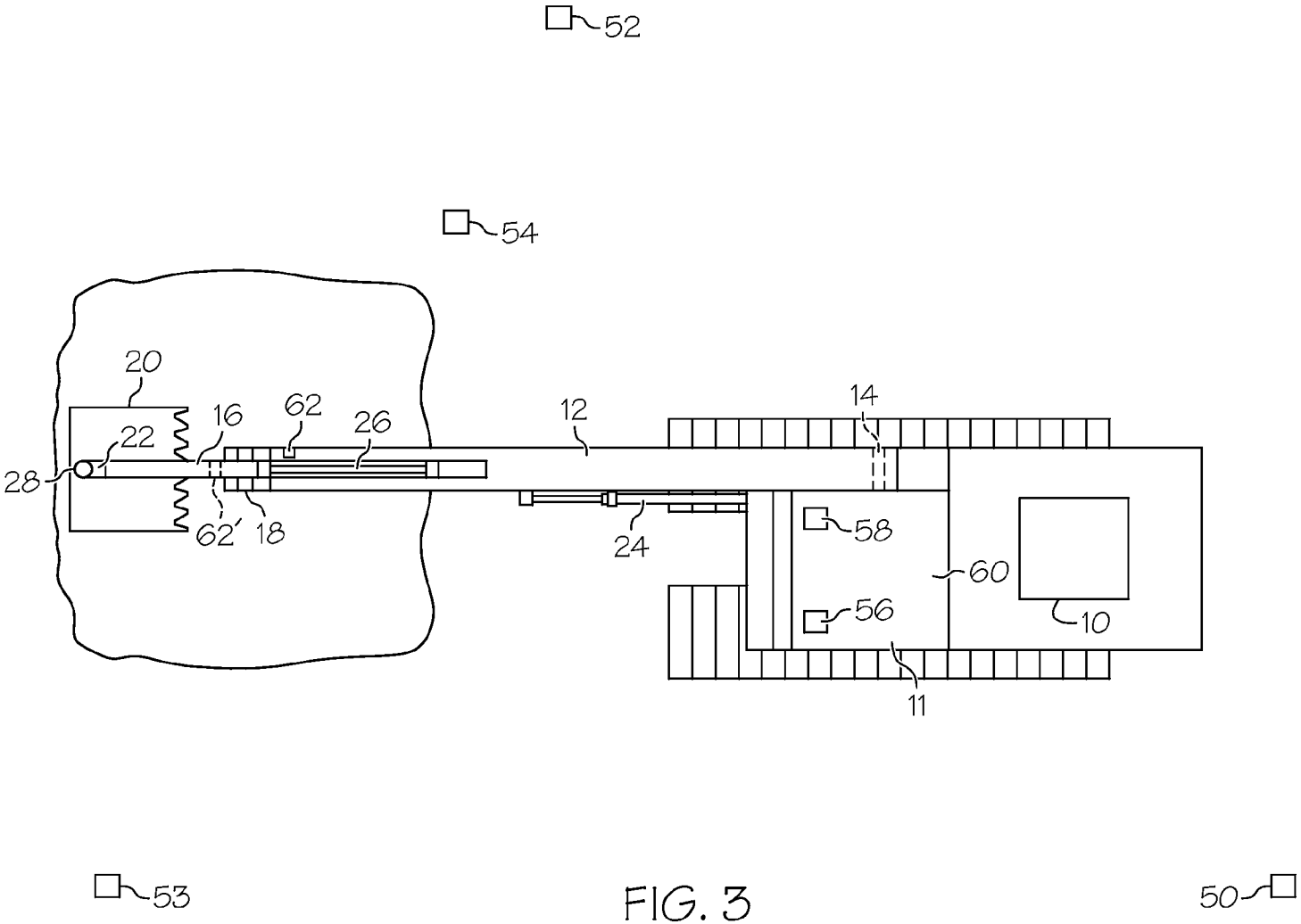
FIG. 3 is a diagrammatic view of the embodiment of the bucket sensing system of FIGS. 1 and 2, as seen from above.

FIGS. 1-3 and FIG. 5 of the drawings illustrates a bucket sensing system for use with an excavation machine. The excavation machine 10 is an excavator of the type that includes a chassis 11, a boom 12 pivotally secured to the chassis 11 at a first pivot joint 14, a dipper stick 16 pivotally secured to the boom 12 at a second pivot joint 18, and a bucket 20 pivotally secured to the dipper stick 16 at a third pivot joint 22. The boom 12 and dipper stick 16 constitute bucket support elements that support and position the bucket 20 as desired. Hydraulic cylinders 24, 26, and 28 are actuated to cause relative movement of boom 12 with respect to chassis 11, of dipper stick 16 with respect to boom 12 and of bucket 20 with respect to dipper stick 16, respectively. Bucket 20 includes a cutting edge 30 which may have serrated teeth.

The bucket sensing system includes a plurality of fixed ranging radios 50, 52, 53, and 54 that are positioned at known locations at the worksite. Preferably ranging radios 50-54 are ultra wide band radios. Ranging radios 50-54 define a number of reference points at the worksite from which the location of the excavation machine 10, and the various components of the excavation machine 10, including the bucket 30, may be determined.

The three dimensional position of each fixed ranging radio 50-54 is established prior to system operation by any conventional surveying technique. As illustrated, the ranging radios 50-54 need not be laid out in a regular pattern or with uniform spacing. The system further includes a pair of ranging radios 56 and 58, mounted on the chassis 11 of the excavating machine 10. The radios 56 and 58 are shown mounted on the roof of the cab 60 of the excavation machine 10, but they may be positioned at other locations, if desired or convenient. A third ranging radio is mounted on one of the bucket support elements, illustrated in solid lines at 62 in FIGS. 1-3 as mounted on the boom 12 of the excavation machine 10, and illustrated in dashed lines at 62' in FIGS. 1-3 as mounted on the dipper stick 16 of the excavation machine 10.

During operation of the system, the ranging radios 58, 58, and 62 or 62' repeatedly broadcast to each of the fixed ranging radios 50, 52, 54, and 56, to determine the distances from each of the ranging radios 56, 58, and 62 or 62' to each of the fixed ranging radios 50, 52, 54 and 56. A measurement circuit 70 on the excavation machine 10 is responsive to the pair of ranging radios 56 and 58 and to the third ranging radio 62 or 62'. The measurement circuit 70 determines the position and orientation of the excavator chassis 11 and the bucket support elements 12 and 16 with respect to the plurality of fixed ranging radios 50-54 by triangulation techniques. Since the locations of the fixed ranging radios at the worksite are known, the locations of the ranging radios 56, 58 and 62 or 62' are determined. These known locations then provides the basis for determining the location and orientation of the elements of the excavation machine 10.

An angle sensor 80 is mounted at the pivot 18, providing an output indicating the angular orientation β between the reference line 81 and the reference line 83. Further, an angle sensor 82 may be mounted at the pivot 22, providing an output indicating the angular orientation a between the reference line 81 and the reference line 85. The angle-measuring sensors 80 and 82 may be shaft angle encoders. The reference line 81 extends between pivot joints 18 and 22; the reference line 83 extends between pivot joints 14 and 18; and the reference line 85 extends between pivot joint 22 and the teeth 30 of the bucket 20. The angle B, which is the angle included between reference line 81 and a horizontal reference line 87, may be determined by subtracting the angle A, the downward slope of line 83, from angle β. The angle A may be determined in several ways, including an inclinometer 89 mounted on the boom 12. The angle A may also be determined by assessing the relative positions of the ranging radios 56, 58 and 62, with the angle A begin directly related to the vertical position of the three ranging radios. Other alternative angle measuring arrangements may be used, such as sensors which monitor the extension of cylinders 24, 26 and 28.

The angle θ is equal to the angle B minus 90°. Similarly, the angle Δ is equal to the angle a plus the angle θ, minus 90°. Knowing the angles θ and α allows for the straightforward calculation of distances $D_1$ and $D_2$, the sum of which is equal to the difference in elevation of the teeth 30 of bucket 20 the elevation of the pivot 18.

Figure 5:
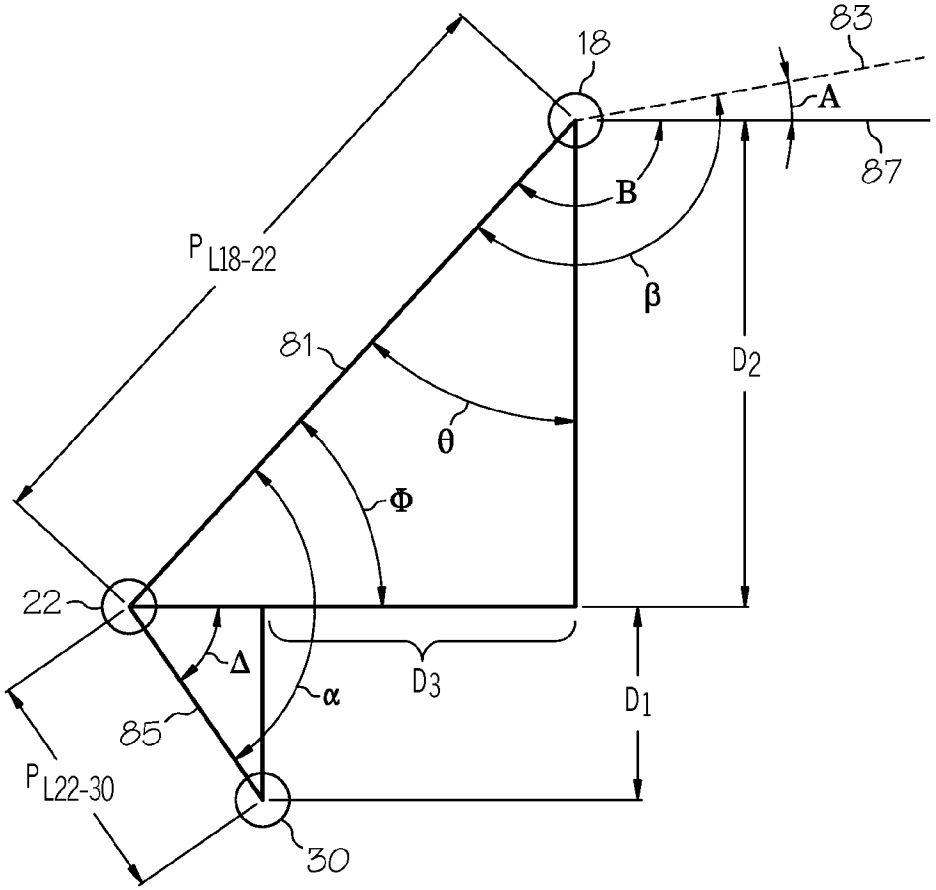
FIG. 5 is a schematic representation of the dipper stick and bucket geometry, useful in understanding the equations associated with bucket height calculations.

As shown in FIG. 5, the geometry of the dipper stick 16, the bucket 20, hinged to the dipper stick 16 at joint 22, and the teeth 30 of the bucket 20, permits ready calculations of the location of the teeth 30 with respect to the pivot joint 18. Again we define the variables as follows:

A=Inclinometer 87 output

β=Angle sensor 80 output at pivot 18

α=Angle sensor 82 output at pivot 22

$P_{L18-22}$=Distance between pivot joints 18 and 22

$P_{L22-30}$=Distance between pivot joints 22 and teeth 30

B=β−A $$\theta=(B-90°)=(\beta-A-90°)$$

$$\Phi=(180°-B)=[180°-(\beta-A)]$$

$$\Delta=(\alpha-\Phi)=[\alpha-(180°-B)]=[\alpha-180°+(\beta-A)]$$

$$\Delta=[\alpha-180°+\beta-A]$$

It becomes apparent that:

$$D_1=P_{L22\text{-}30}\cdot\mathrm{SIN}(\Delta) \text{ or}$$

$$D_1=P_{L22\text{-}30}\cdot\mathrm{SIN}\,[\alpha-180°+\beta-A],$$

And, $$D_2=P_{L18\text{-}22}\cdot\mathrm{COS}(\theta) \text{ or}$$

$$D_2=P_{L18\text{-}22}\cdot\mathrm{COS}\,[\beta-A-90°]$$

From this we see that the height of the teeth 30 of the bucket 20 is below the height of the pivot joint 18 by a distance:

$$D_1+D_2=P_{L22\text{-}30}\cdot\mathrm{SIN}\,[\alpha-180°+\beta-A]+P_{L18\text{-}22}\cdot\mathrm{COS}\,[\beta-A-90°]$$

The teeth 30 are further away laterally from the excavator than the joint 18 by a distance $D_3$. It will be apparent that:

$$D_3=P_{L18\text{-}22}\cdot\mathrm{SIN}(\theta)-P_{L22\text{-}30}\cdot\mathrm{COS}(\Delta)$$

$$D_3=P_{L18\text{-}22}\cdot\mathrm{SIN}\,[\beta-A-90°]-P_{L22\text{-}30}\cdot\mathrm{COS}\,[\alpha-180°+\beta-A]$$

The position of the pivot joint 18 is determined in three dimensions using the outputs from inclinometer 87 and the ranging radios 56, 58 and 62. The relative vertical position of the joint 18 is determined with respect to the vertical position of the ranging radio 62. The x and y coordinates of the joint 18 are determined by using the outputs of the inclinometer 87 and ranging radios 56, 58 and 62 to determine the lateral spacing between the ranging radio 62 and the joint 18 in both coordinate directions. Similarly, knowing the distance D3, determined above, and x and y coordinates of the pivot joint 18, and the heading or orientation of the excavator, as determined by the ranging radios 56, 58 and 62, the x and y coordinates of the teeth 30 are determined.

It will be appreciated that an inclinometer 40 on the dipper stick 16 may be used in lieu of the angle sensor 80. Such an inclinometer provides a direct measurement of the angle θ. It will be further appreciated that the measurement circuit 70 will determine not only the elevation of the teeth 30, but also position of the teeth 30 in all three dimensions and the orientation of the teeth, based on the locations of the ranging radios 56, 58 and 62 or 62'.

Figure 4:
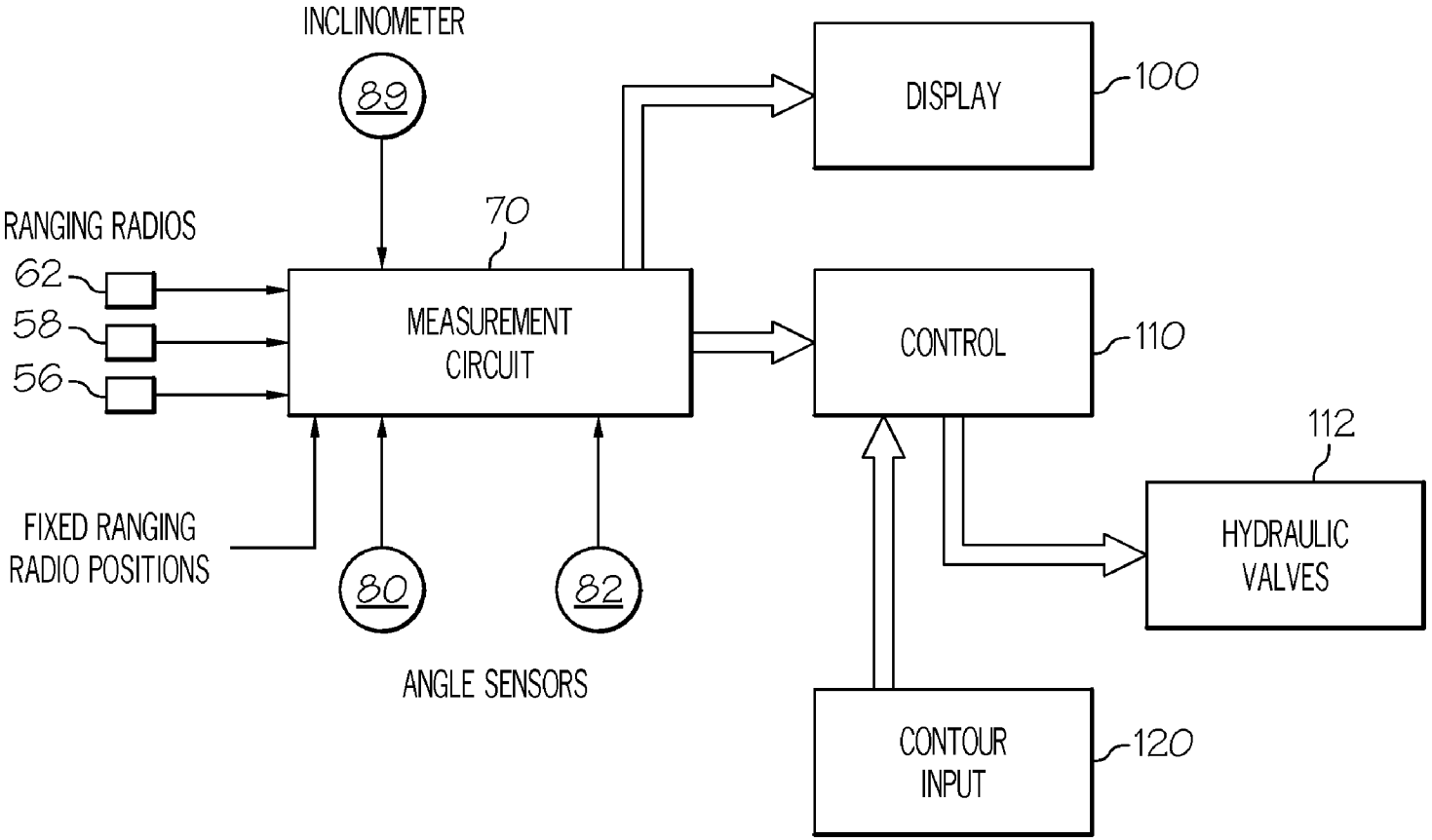
FIG. 4 is a schematic diagram, showing a measurement circuit, control, and display.

As indicated in FIG. 4, a display 100 is provided on the excavating machine 10 for displaying the position and orientation of the excavator chassis 11 and the bucket support elements 12 and 16 with respect to the plurality of fixed ranging radios 50, 52, 53 and 54, as well as the position and orientation of the bucket 2. The positions of the fixed ranging radios 50, 52, 53, and 54 are supplied to the measurement circuit 70 for the purpose of accomplishing the various calculations. Control 110 may provide control signals to hydraulic valves 112 which control extension and retraction of the hydraulic cylinders 24, 26 and 28. The control 110 responds to the measured positions from circuit 70 to move the bucket 20 in sequence to desired positions for excavating a preselected contour. The contour may be supplied by the operator via input 120.

Although particular embodiments have been described above for purposes of illustration, it will be appreciated by those skilled in the art that numerous variations in these embodiments may be made.

What is claimed is:

1. A system for use with an excavator of the type having a chassis, bucket support elements including a boom extending from said chassis and a dipper stick pivotally mounted on the end of the boom, and an excavator bucket pivotally mounted on the end of the dipper stick, said system determining the position of the excavator bucket during operation of the excavator at a worksite, comprising:

a plurality of fixed ranging radios positioned at known locations at said worksite, a pair of ranging radios mounted on the chassis of the excavator, a third ranging radio mounted on one of said bucket support elements, and a measurement circuit, responsive to said pair of ranging radios and to said third ranging radio, for determining the position and orientation of said excavator and said bucket support elements with respect to said plurality of fixed ranging radios.

2. The system of claim 1 in which said third ranging radio is mounted on said boom of said excavator.

3. The system of claim 1 in which said third ranging radio is mounted on said dipper stick of said excavator.

4. The system of claim 1 further comprising an angle sensor providing an output indicating the angular orientation between said boom and said dipper stick, said measurement circuit responsive to said angle sensor output.

5. The system of claim 4 further comprising an angle sensor providing an output indicating the angular orientation between said dipper stick and said bucket, said measurement circuit responsive to said angle sensor output.

6. The system of claim 1, further comprising a display on said excavator for providing a display for the operator of the excavator indicating the position and orientation of said excavator chassis and said bucket support elements with respect to said plurality of fixed ranging radios.

7. The system of claim 5, further comprising a display on said excavator for providing a display for the operator of the excavator indicating the position and orientation of said bucket with respect to said plurality of fixed ranging radios.

8. The system of claim 5, further comprising a control responsive to the measured positions and orientations of said bucket with respect to said plurality of fixed ranging radios, for causing the bucket to be moved in sequence to the desired positions.

9. The system of claim 1, further comprising an inclinometer providing an output indicating the inclination of said dipper stick, said measurement circuit responsive to said inclinometer output.

10. The system of claim 1, further comprising an inclinometer providing an output indicating the inclination of said boom, said measurement circuit responsive to said inclinometer output.

11. A bucket sensing system for use with an excavating machine of the type having a chassis, a boom pivotally secured to said chassis at a first pivot joint, a dipper stick pivotally secured to said boom at a second pivot joint, and a bucket pivotally secured to said dipper stick at a third pivot joint, comprising:

a plurality of fixed ranging radios positioned at known locations at a worksite, a pair of ranging radios mounted on the chassis of the excavating machine, a third ranging radio, mounted on said dipper stick adjacent said second pivot joint and providing an indication of the relative location of the third ranging radio with respect to said plurality of fixed ranging radios, an angle sensor for sensing the angle between said boom and said dipper stick, and a position determining circuit, responsive to said angle sensor, to said pair of ranging radios, and to said third ranging radio, for determining the position of said third pivot joint based on the outputs of said angle sensor and said ranging radios.

12. The bucket sensing system of claim 11, further comprising an angle sensor for sensing the angle between said dipper stick and said bucket, whereby said position determining circuit may determine the position of the bucket teeth based on the outputs of said angle sensors and said ranging radios.

13. The bucket sensing system of claim 12, further comprising a display on said excavating machine for displaying to the machine operator the position of the bucket.

14. A bucket sensing system for use with an excavating machine of the type having a chassis, a boom pivotally secured to said chassis at a first pivot joint, a dipper stick pivotally secured to said boom at a second pivot joint, and a bucket pivotally secured to said dipper stick at a third pivot joint, said bucket having cutting teeth, comprising:

a plurality of fixed ranging radios positioned at known locations at a worksite, a pair of ranging radios mounted on the chassis of the excavating machine, a third ranging radio, mounted on said boom adjacent said second pivot joint and providing an indication of the relative location of the third ranging radio with respect to said plurality of fixed ranging radios, an angle sensor for sensing the angle between said boom and said dipper stick, and a position determining circuit, responsive to said angle sensor, to said pair of ranging radios, and to said third ranging radio, for determining the position of said third pivot joint based on the outputs of said angle sensor and said ranging radios.

15. The bucket sensing system of claim 14, further comprising an angle sensor for sensing the angle between said dipper stick and said bucket, whereby said position determining circuit may determine the position of the cutting teeth of the bucket based on the outputs of said angle sensors and said ranging radios.

16. The bucket sensing system of claim 15, further comprising a display on said excavating machine for displaying to the machine operator the position of the bucket.

* * * * *